US010809025B2

(12) United States Patent
Harrigan et al.

(10) Patent No.: US 10,809,025 B2
(45) Date of Patent: Oct. 20, 2020

(54) PISTOL

(71) Applicant: ZRODELTA, LLC, Connelly Springs, NC (US)

(72) Inventors: Patrick L. Harrigan, Hickory, NC (US); Johnathan Charles Birk, Hickory, NC (US); Joel Edwards, Valdese, NC (US); Timothy Wayne Raley, Lubbock, TX (US)

(73) Assignee: ZRODELTA, LLC, Connelly Springs, NC (US)

( * ) Notice: Subject to any disclaimer, the term of this patent is extended or adjusted under 35 U.S.C. 154(b) by 0 days.

(21) Appl. No.: 16/209,925

(22) Filed: Dec. 4, 2018

(65) Prior Publication Data

US 2019/0107348 A1 Apr. 11, 2019

Related U.S. Application Data

(63) Continuation-in-part of application No. 15/678,483, filed on Aug. 16, 2017, now Pat. No. 10,260,828.
(Continued)

(51) Int. Cl.
*F41A 3/66* (2006.01)
*F41C 23/14* (2006.01)
(Continued)

(52) U.S. Cl.
CPC ..... *F41A 3/66* (2013.01); *F41A 5/02* (2013.01); *F41A 11/00* (2013.01); *F41C 23/10* (2013.01);
(Continued)

(58) Field of Classification Search
CPC ..... F41C 23/10; F41C 23/16; F41C 33/08; F41C 3/66; F41A 11/00
See application file for complete search history.

(56) References Cited

U.S. PATENT DOCUMENTS 4,893,546 A 1/1990 Glock
5,231,237 A * 7/1993 Cupp ..... F41C 23/10 42/71.02

(Continued)

OTHER PUBLICATIONS

US 9,644,908 B2, 05/2017, Gomez (withdrawn)
"Glock." Wikipedia, Jun. 25, 2017, https://en.wikipedia.org/wiki/Glock. Accessed Jun. 30, 2017.

*Primary Examiner* — J. Woodrow Eldred
(74) *Attorney, Agent, or Firm* — Bennet K. Langlotz; Langlotz Patent & Trademark Works, LLC

(57) ABSTRACT

Pistols have a body having a grip, the grip defining an elongated magazine passage adapted to receive a magazine and defining a magazine axis, the grip having opposed left and right side walls and a front portion and an opposed rear portion, the body having an upper portion having a first linear interface element aligned with an attachment axis offset from the magazine axis, and a removable backstrap element adapted to overlay the rear portion of the grip and having a second linear interface element adapted to removably connect to the first linear interface element. The pistol frame may include slide rails defining a slide plane, and the first linear interface element may be parallel to the slide plane. The first linear interface element and the second linear interface element may comprise a sliding interface. The sliding interface may be a dovetail feature.

20 Claims, 16 Drawing Sheets

Related U.S. Application Data

(60) Provisional application No. 62/623,042, filed on Jan. 29, 2018.

(51) Int. Cl.

| | |
|---|---|
| ***F41C 23/10*** | (2006.01) |
| ***F41A 11/00*** | (2006.01) |
| ***F41A 5/02*** | (2006.01) |
| *F41A 3/86* | (2006.01) |
| *F41A 19/10* | (2006.01) |

(52) U.S. Cl.

CPC ..... *F41C 23/14* (2013.01); *F41A 3/86* (2013.01); *F41A 19/10* (2013.01)

(56) References Cited

U.S. PATENT DOCUMENTS

| | | | | |
|---|---|---|---|---|
| 7,347,022 | B2 * | 3/2008 | Gussalli Beretta ..... | F41A 19/15 42/69.01 |
| 8,438,772 | B2 * | 5/2013 | Andreis ..... | F41C 23/10 42/71.01 |
| 8,528,243 | B1 | 9/2013 | Glock | |
| 2010/0139144 | A1 * | 6/2010 | Fitzpatrick ..... | F41A 11/02 42/73 |
| 2014/0007479 | A1 | 1/2014 | Glock | |

* cited by examiner

PISTOL

CROSS-REFERENCE TO RELATED APPLICATION

This application is a Continuation-in-Part of U.S. patent application Ser. No. 15/678,483 filed on Aug. 16, 2017, entitled "RECEIVER ASSEMBLY FOR LOCKED BREECH PISTOL," and also claims the benefit of U.S. Provisional Patent Application No. 62/623,042 filed on Jan. 29, 2018, entitled "DETACHABLE AND MODULAR HANDGUN DUST COVER," which is hereby incorporated by reference in its entirety for all that is taught and disclosed therein.

FIELD OF THE INVENTION

The present invention relates a pistol receiver assembly. In particular, it relates to a receiver assembly for a semi-automatic pistol.

BACKGROUND OF THE INVENTION

The introduction of the semi-automatic pistol having a short recoil locked breech (hereinafter semi-automatic pistol) by Glock revolutionized the pistol market for semi-automatic weaponry. While the slide, barrel, and recoil spring are made of steel, the remaining receiver assembly is a one-piece device. About 90% of the receiver assembly is plastic. The receiver assembly is manufactured as a single-piece assembly. If you wish to have a different part of the receiver assembly, it is necessary to replace the entire assembly.

In addition, while the lightweight nature of plastic adds some advantages, as the gun heats up during use, the differences in expansion coefficients for steel versus plastic have been known to cause some problems. In addition, if a portion of the assembly is damaged, once again, the entire assembly must be replaced. At this point, however, no one has determined how to design a multiple piece receiver assembly which overcomes the problems associated with the current technology for semi-automatic pistols.

Therefore, a need exists for a new and improved pistol that is modular in construction, thereby providing extensive customization options for the user without requiring replacement of the entire receiver assembly. In this regard, the various embodiments of the present invention substantially fulfill at least some of these needs. In this respect, the pistol according to the present invention substantially departs from the conventional concepts and designs of the prior art, and in doing so provides an apparatus primarily developed for the purpose of providing a pistol that is modular in construction, thereby providing extensive customization options for the user without requiring replacement of the entire receiver assembly.

SUMMARY OF THE INVENTION

The current invention relates to a semi-automatic pistol assembly wherein there are multiple pieces that fit together to form a receiver assembly. Because of the nature of the design, the assembly can be plastic, as in previous models, but can also be entirely of metal, which not only allows for solving the problems noted above, but allows for further customizing of the receiver assembly without having to have a new assembly for each modification.

To attain this, the preferred embodiment of the present invention essentially comprises a body having a grip, the grip defining an elongated magazine passage adapted to receive a magazine and defining a magazine axis, the grip having opposed left and right side walls and a front portion and an opposed rear portion, the body having an upper portion having a first linear interface element aligned with an attachment axis offset from the magazine axis, and a removable backstrap element adapted to overlay the rear portion of the grip and having a second linear interface element adapted to removably connect to the first linear interface element. The pistol frame may include slide rails defining a slide plane, and the first linear interface element may be parallel to the slide plane. The first linear interface element and the second linear interface element may comprise a sliding interface. The sliding interface may be a dovetail feature. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DETAILED DESCRIPTION OF THE INVENTION

Figure 1A:
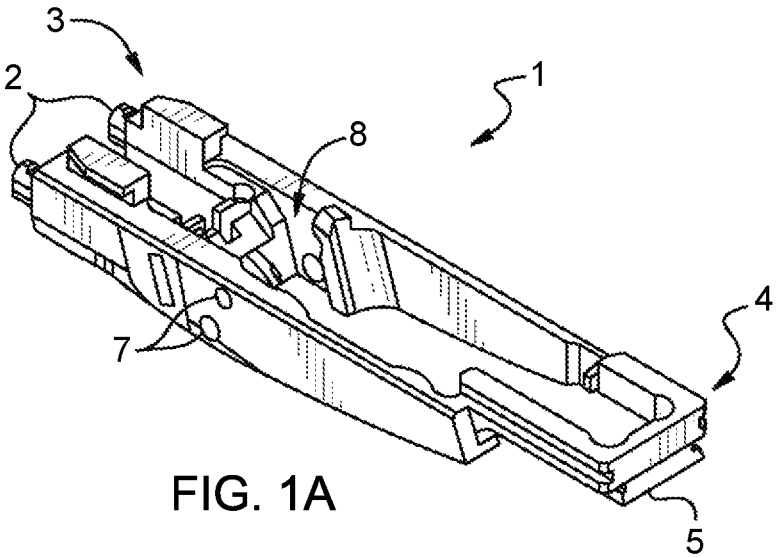
FIGS. 1A and 1B are perspective views of the sub-receiver.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals, if any, are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps or acts are in some way inherently mutually exclusive.

The drawings featured in the figures, if any, are for the purpose of illustrating certain convenient embodiments of the present invention, and are not to be considered as limitation thereto. The term "means" preceding a present participle of an operation indicates a desired function for which there are one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "semi-automatic pistol" refers to a semi-automatic pistol having a short recoil locked breech. These are the pistols generally referred to in the trade as Glock pistols or Glock safe "Action®" pistols. These are various caliber bullet type pistols which, in the prior art, have a one-piece metal and plastic receiver assembly. As used herein, the term "semi-automatic receiver assembly" refers to a collection or kit of parts comprising a sub receiver, a front dust cover, a pistol grip frame, and at least one of a front and rear grip strap which assemble into a receiver for accepting a trigger assembly, a slide, a barrel, a recoil spring assembly, a bullet magazine tube, and a magazine well funnel.

As used herein, the term "sub receiver" refers to a piece of the whole receiver that is designed to receive the barrel and the slide with the recoil spring attached. In the original Glock, this is just a molded area and not a separate piece. The front of the sub receiver has a device for removably attaching a front dust cover. In the first embodiment shown in the Figures, there are two cylindrical locking posts. These each have a spring-loaded ball bearing and front with two holes in the front dust cover to assemble the pieces together.

As used herein, the term "front dust cover" refers to a piece, as shown in the Figures, which attaches to the front of the sub receiver. It is a protective cover positioned below the barrel to protect the exposed bottom portion of the barrel on the pistol, the top portion covered by the slide assembly. In one embodiment, there are two holes on the back side for mounting/connecting to the receiver sub-assembly, as shown in the Figures.

As used herein the term "pistol grip frame" refers to the portion of the pistol, as shown in the Figures, which includes the trigger guard, the trigger mounting, the handle to hold the pistol, trigger guard, and a space to insert the magazine tube assembly.

As used herein the term "grip strap" refers to a detachable front and back piece which, as shown in the Figures, mounts to the front and back of the handle on the pistol grip frame in order to change the size of the grip handle for different size hands. The connection can be by any means. In one embodiment, it is a removable attachment, for example by screws, clips, or the like.

As used herein, the term "magazine well funnel" refers to a device at the end of the space to insert the magazine tube assembly which widens the opening in a funnel fashion to make it easier to insert a magazine with bullets into the magazine well.

As used herein, the term "trigger assembly" refers to the mechanism in a semi-automatic pistol that comprises the trigger and the mechanism used to transfer the trigger movement to firing a bullet. A representative example of such mechanism is shown in the Figures and mounts on the pistol grip frame.

As used herein, the term "slide" refers to the standard slide used with semi-automatic pistols and is well known in the art.

As used herein, the term "barrel" refers to a standard barrel used with semi-automatic pistols and is well known in the art.

As used herein, the term "recoil spring assembly" refers to the standard recoil spring used in semi-automatic pistols and is well known in the art.

As used herein, the term "magazine tube assembly" refers to the magazine that holds bullets, e.g. 9 mm bullets, that is inserted into the grip frame handle for delivering bullets during use. The standard semi-automatic pistol magazine is intended.

DRAWINGS

Figure 1B:
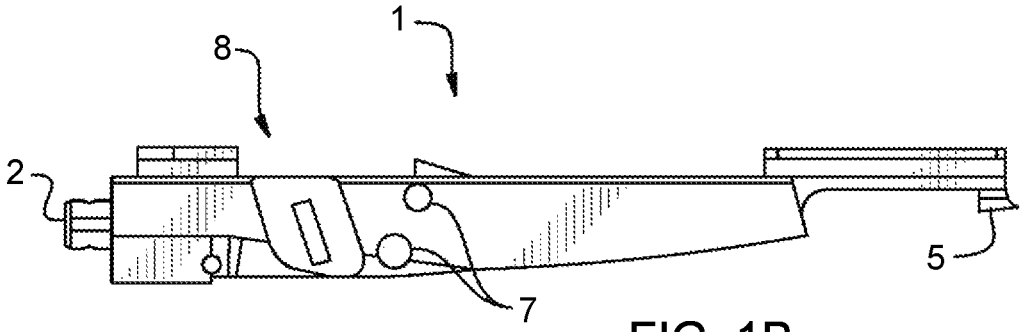

Now referring to the drawings, FIG. 1A is a perspective view of the receiver sub-assembly 1 of the present invention. In this view, there are two locking posts 2 in the front 3 of the sub-assembly 1 for mounting the front dust cover. In the back 4 of the sub-assembly, there is a slide clip 5 for mounting to the pistol grip frame. For additional mounting to the grip frame are pin holes 7 which mate with holes on the pistol grip frame. The internal mechanism 8 is designed to hold the barrel and receiver in the manner known in the art. FIG. 1B is a side view of the sub-assembly 1.

Figure 2:
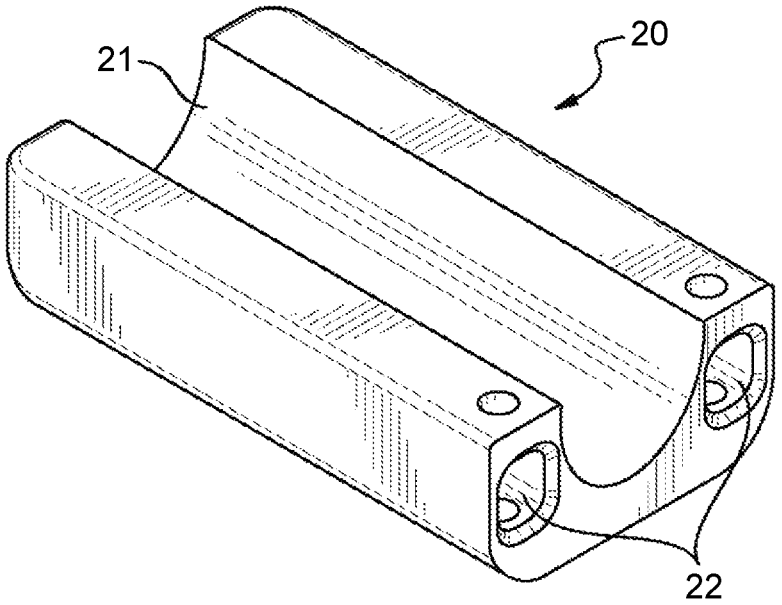
FIG. 2 is a perspective view of the front dust cover.

FIG. 2 is a front dust cover 20 having channel 21 for clearance of the recoil spring and mounting holes 22 for receiving the posts of the sub-assembly and connecting the two.

Figure 3:
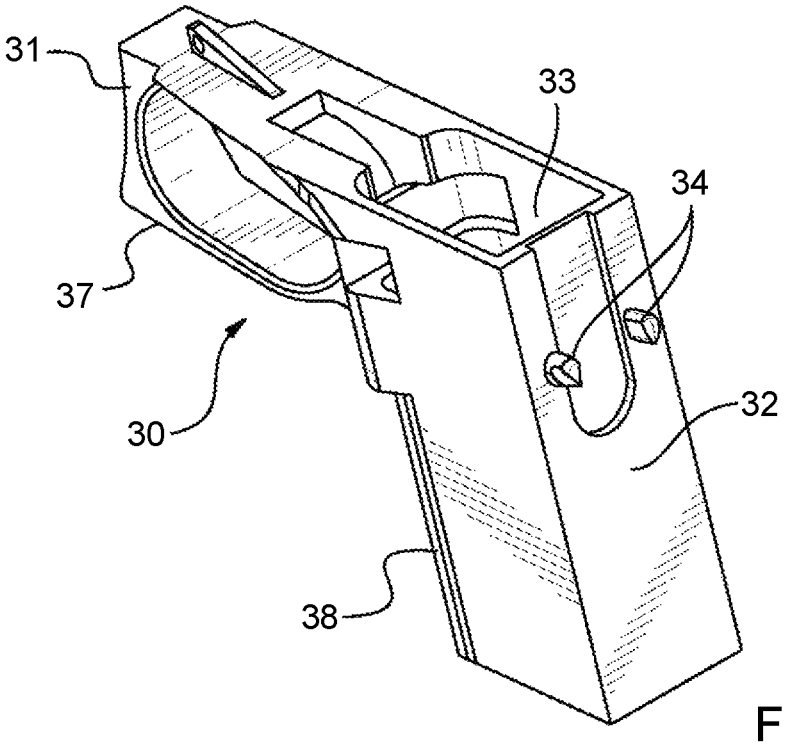
FIG. 3 is a perspective view of the pistol grip frame.

FIG. 3 is a perspective view of the pistol grip frame 30 where the receiver mounts to the grip frame 30 at front 31. The grip frame 30 has handle 32 for receiving a magazine in a well 33 and mounting lugs 34 for receiving a back grip strap. A front grip strap 38 is already attached to the front of handle 32. It is designed to receive a trigger assembly and position a trigger in trigger guard 37.

Figure 4:
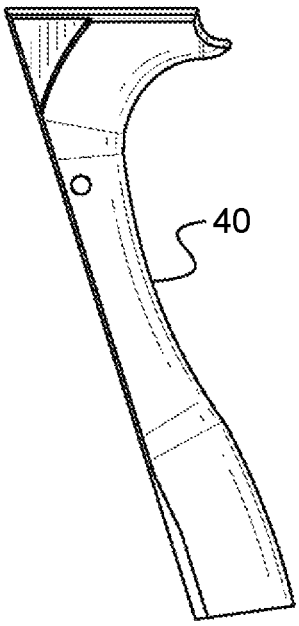
FIG. 4 is a perspective view of the grip back strap.

FIG. 4 is a side view of a grip back strap 40 which mounts on the mounting nuts 34 of the pistol grip frame handle 32, shown in FIG. 3.

Figure 5:
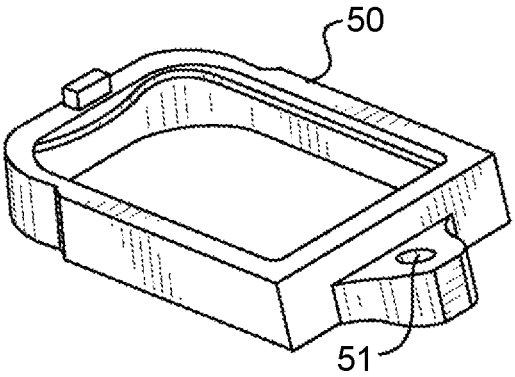
FIG. 5 is a perspective view of the magazine well funnel.
Figure 9:
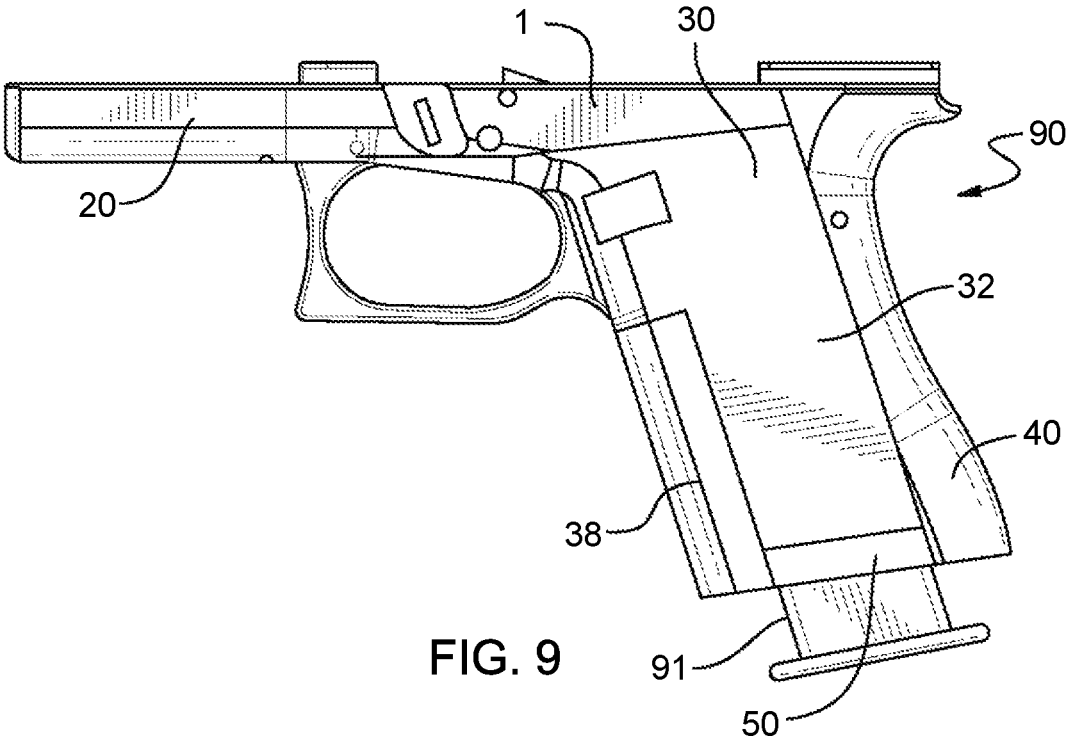
FIG. 9 is a side view of the assembled receiver assembly of the invention.
Figure 10:
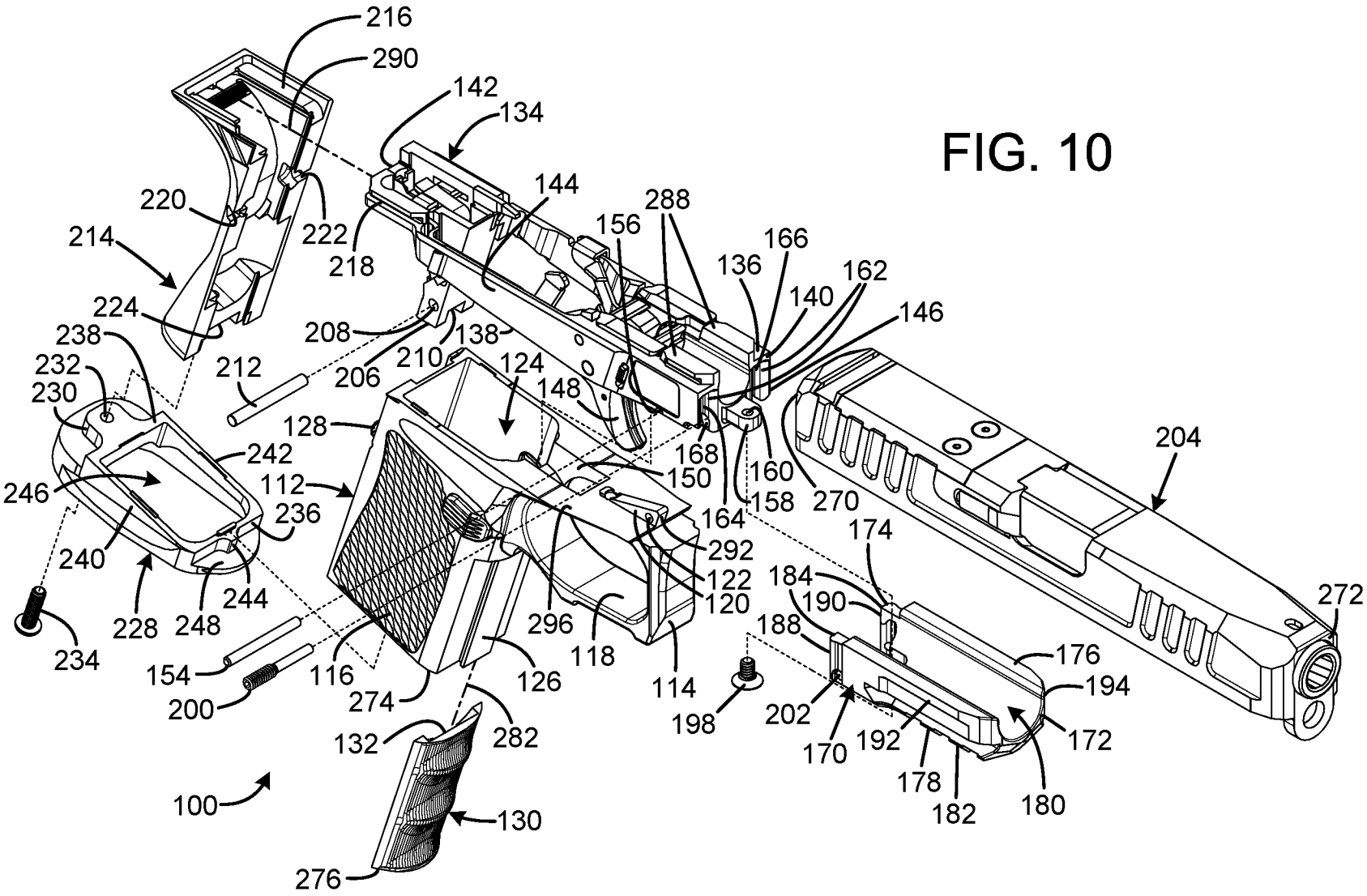
FIG. 10 is a top front isometric exploded view of a first alternative embodiment of the pistol constructed in accordance with the principles of the present invention.
Figure 11:
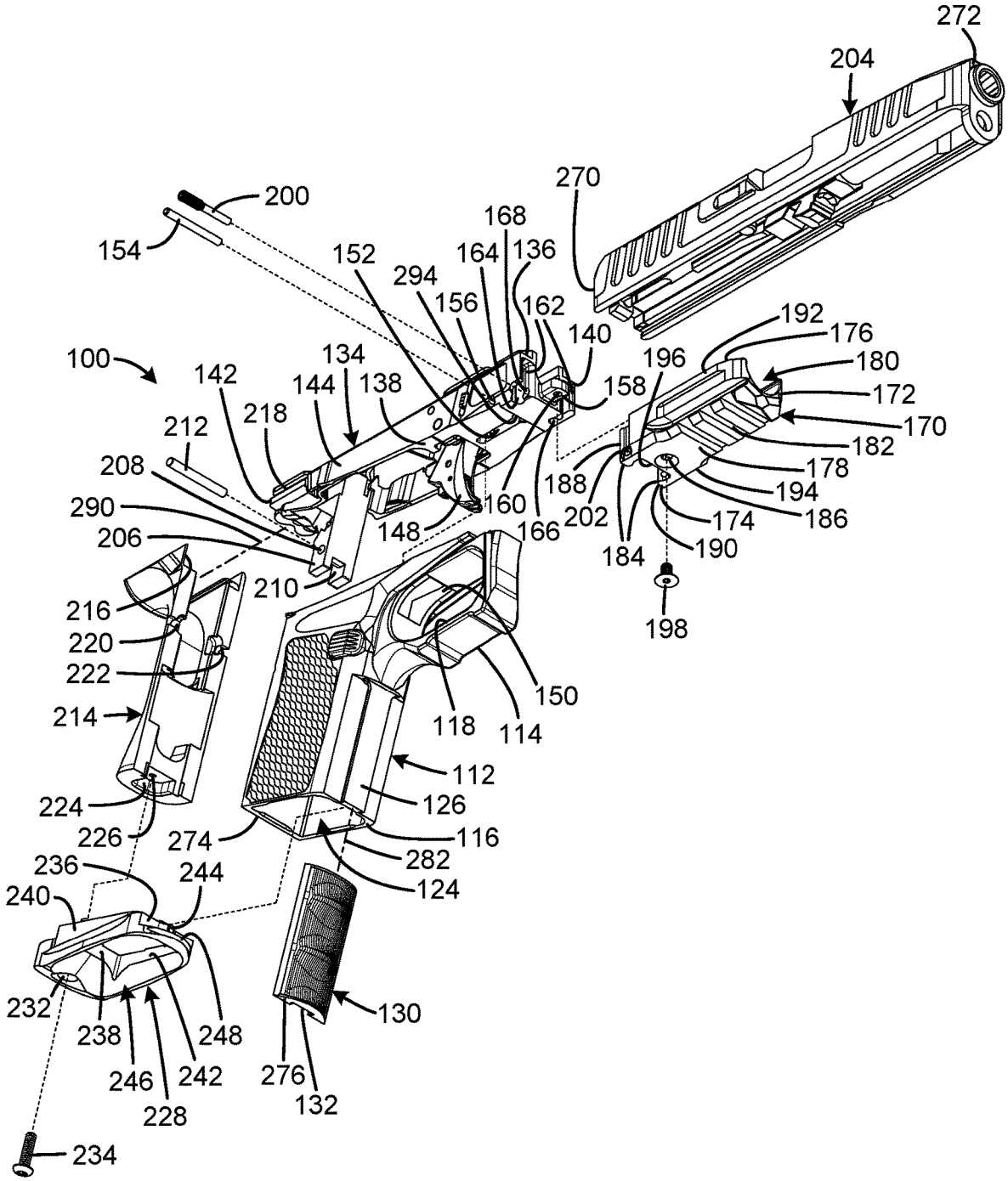
FIG. 11 is a bottom front isometric exploded view of the pistol of FIG. 10.
Figure 12:
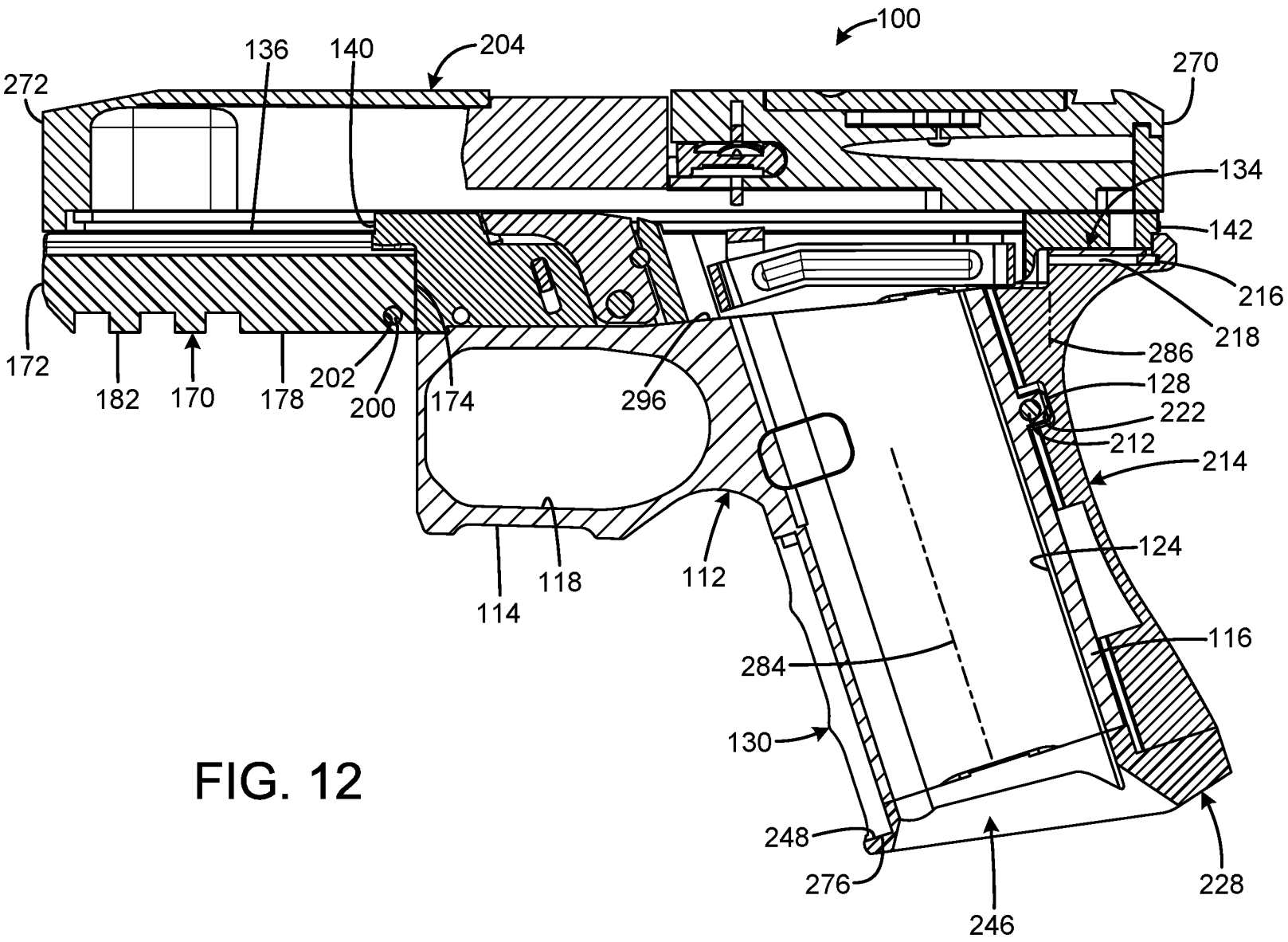
FIG. 12 is a left side sectional view of the pistol of FIG. 10.
Figure 13:
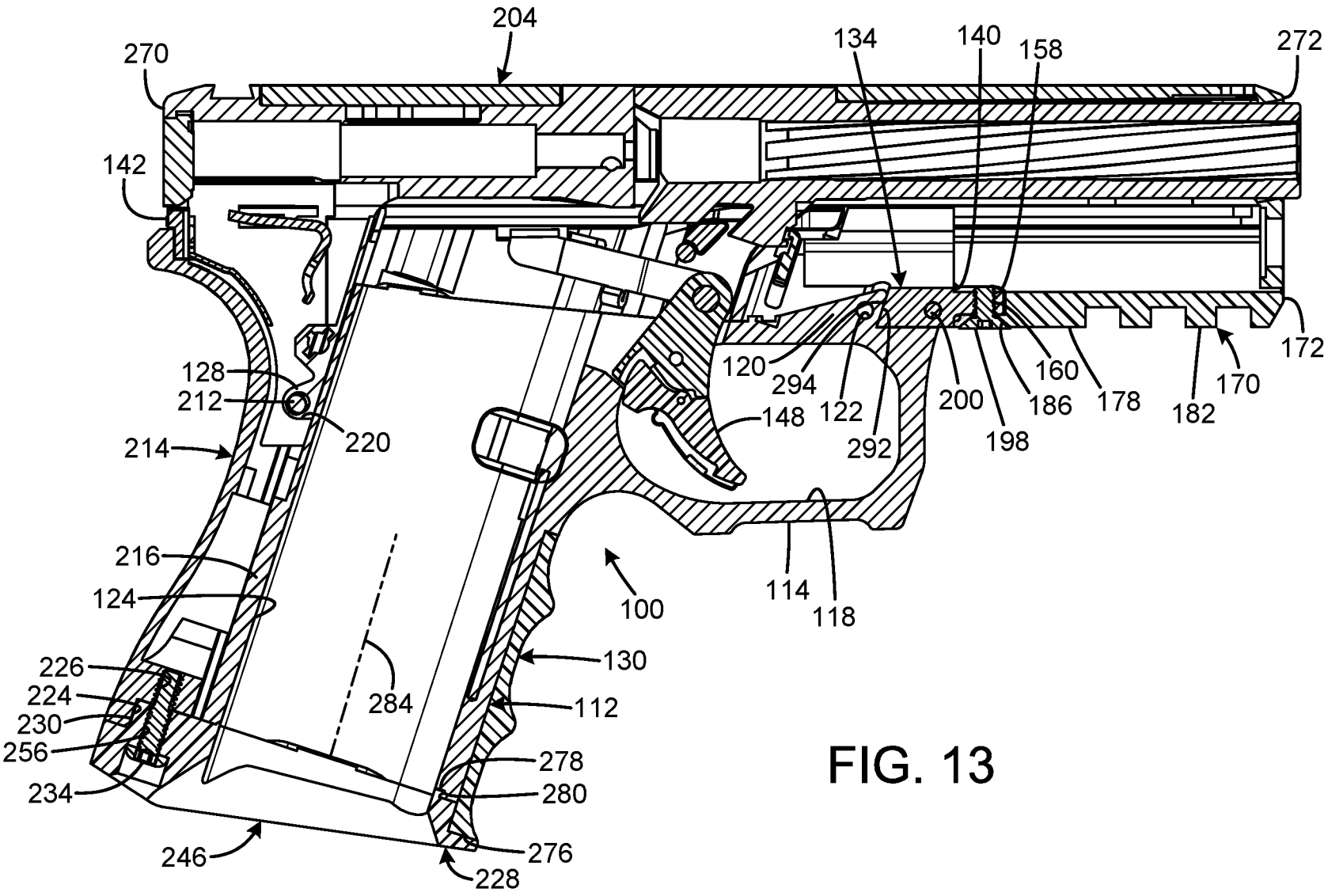
FIG. 13 is a right side sectional view of the pistol of FIG. 10.
Figure 14:
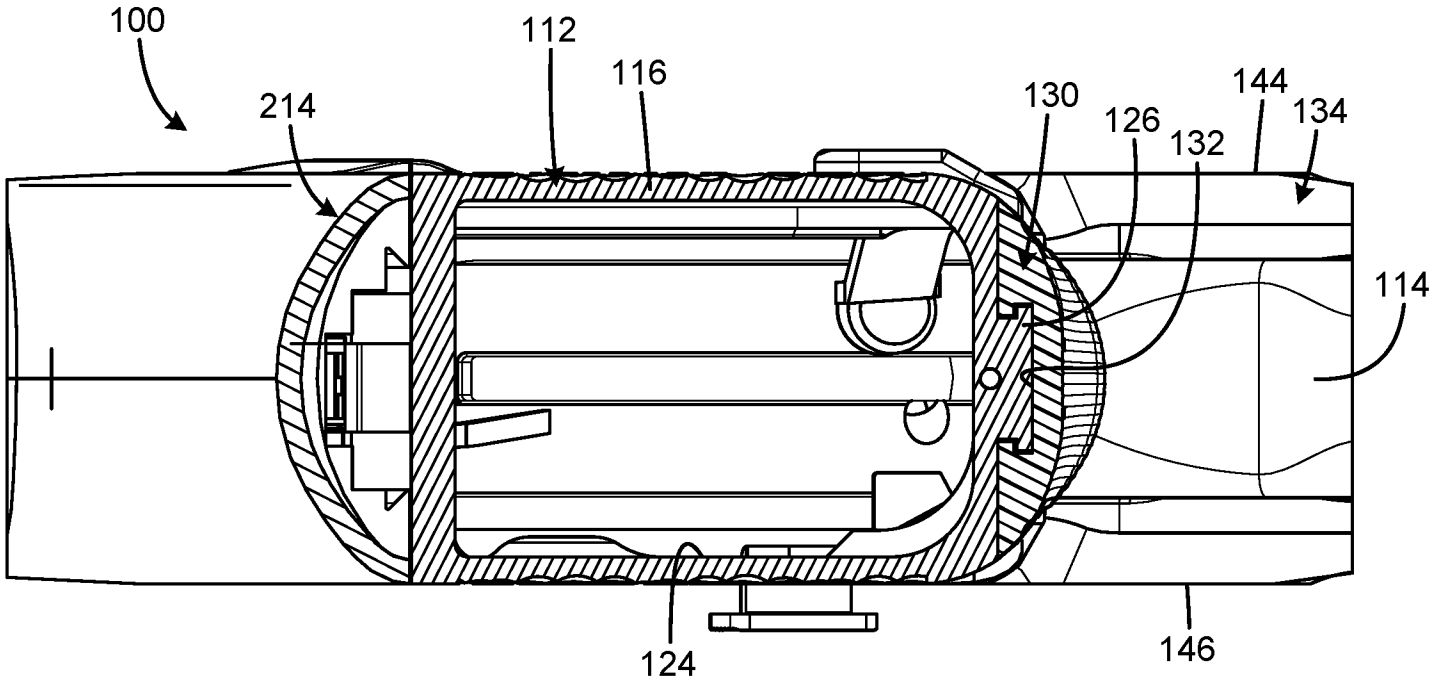
FIG. 14 is a bottom sectional partial view of the pistol of FIG. 10.

FIG. 5 is a magazine well funnel 50 which mounts on the bottom of the pistol grip frame handle for making it easier to insert a magazine quickly by increasing the size of the initial opening. Mounting is shown in FIG. 9. In this view, screws are used with mounting holes 51 to attach the well funnel 50.

Figure 6:
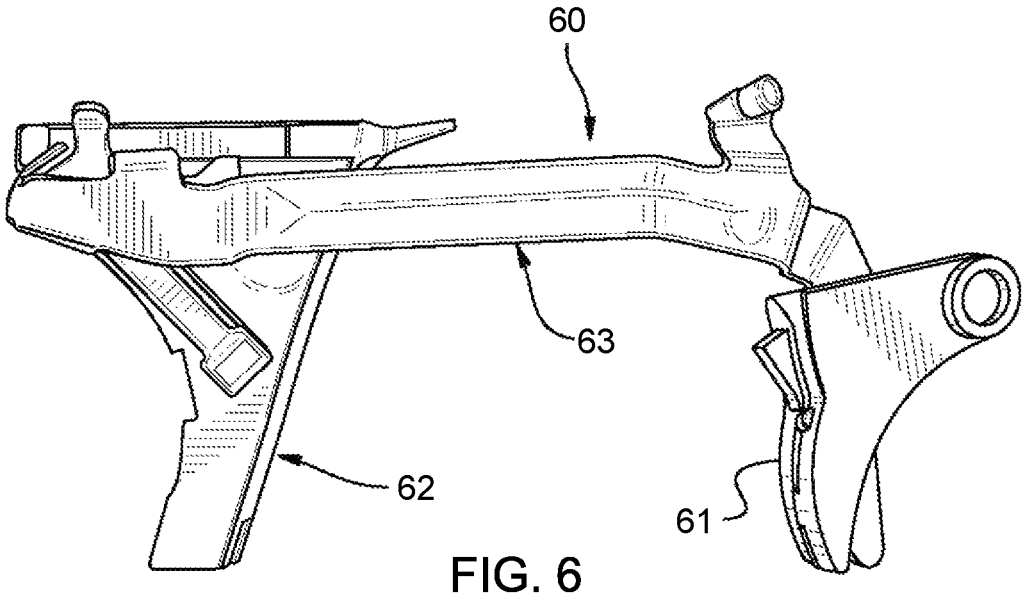
FIG. 6 is a perspective view of the trigger assembly.

FIG. 6 shows a typical trigger assembly 60. In this view, we see trigger 61, connector 62, and trigger bar 63 which is inserted into the pistol grip frame in the normal manner known in the art.

Figure 7:
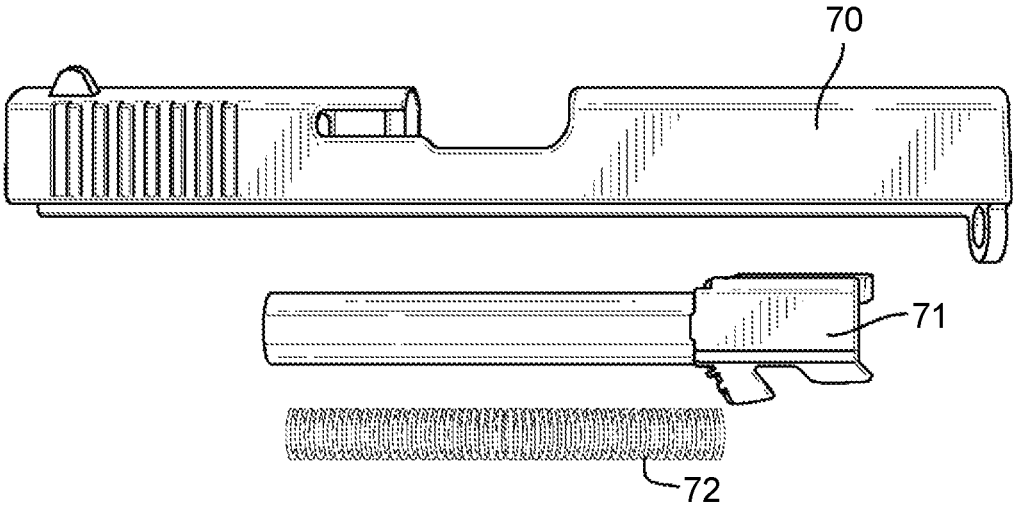
FIG. 7 is a side view of a slide, barrel, and recoil spring.

FIG. 7 shows a side view of the typical slide 70, barrel 71, and recoil spring 72 which is used in a semi-automatic pistol. These items are within the skill of the art and the present invention, as noted above, is designed to receive these items.

Figure 8:
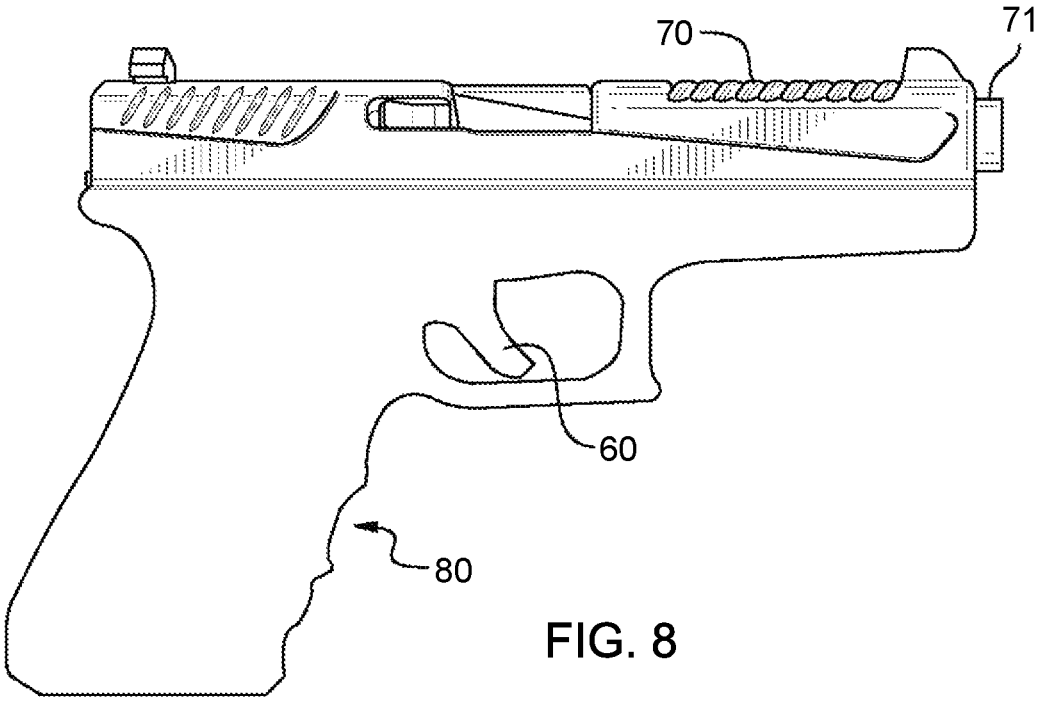
FIG. 8 is a side view of the trigger, slide barrel, and recoil spring mounted on the assembly of the present invention.

FIG. 8 shows the assembled slide 70 with the barrel 71 and spring (hidden from view) and trigger assembly 60 on an assembled receiver assembly of the invention 80.

FIG. 9 is the assembled semi-automatic pistol receiver 90 of the invention. In this view, bullet magazine 91 is shown being inserted into the receiver assembly 90. The parts from the previous figures are numbered here to show their position in the assembled product.

FIGS. 10-14 illustrate an alternative embodiment of the improved pistol 100 of the present invention. More particularly, the pistol has a body 112 having a forward trigger guard 114, a rearward grip 116, and an upper surface 296. The trigger guard defines a trigger space 118. A recoil lug 120 having a transverse bore 122 is located on top of the trigger guard forward of an elongated central magazine passage 124 defined by the grip. The recoil lug is a protrusion extending upward from the upper surface of the body having a forward-facing first bearing surface 292. The magazine passage is adapted to receive a magazine and defines a magazine axis 284. The grip has opposed left and right side walls, a front portion, and an opposed rear portion. The front portion of the pistol grip frame includes a first front grip strap attachment facility, which is a dovetail 126. In the specification, the term dovetail feature is not limited to the traditional woodworking tapered shape. The rear portion of the pistol grip frame includes a rear protrusion 128 with a bore (not visible). A front strap element 130 has a second front strap attachment facility, which is a rear slot 132 that slidably receives the dovetail to removably connect the front grip strap element to the dovetail on the pistol grip frame. The front portion of the pistol grip frame defines a front path, and the front grip strap element is an elongated element movable along the front path, such that the front grip strap element is removable for replacement by an alternate front grip strap element. The first front grip strap attachment facility and the second front grip strap attachment facility form a sliding interface. The sliding interface includes a protrusion/male feature having a constant cross-section (the dovetail) and a recess/female element having a constant cross-section (the rear slot) adapted to closely receive the protrusion. In the specification, the term cylindrical is not limited to circular cross-section, but to forms having the same cross-sectional profile along their length. Thus, the sliding interface includes closely mating cylindrical forms defining a sliding axis 282. The sliding interface is parallel to the front path.

The body 112 has a lower rim 274. A magazine funnel element 228 is adapted for connection to the pistol grip frame at the lower rim at an installed position. The top front of the magazine funnel element 228 defines a stop portion/step 248. The step is positioned proximate the front strap element 130 to prevent removal of the front strap element by vertical movement of the front strap element on the dovetail 126 when the magazine funnel element is secured beneath the grip in the installed position a manner to be described subsequently. The front strap element has a lower end surface 276 abutting the step. The lower rim of the grip defines a rim plane, and the front path is perpendicular to the rim plane. The front strap element is an elongated body perpendicular to the rim plane.

A sub receiver 134 is removably connected to the upper surface 296 of the body 112 in a connected position where the lower surface 138 of the sub receiver abuts the upper surface of the body. The sub receiver also has an upper slide interface surface 136 that acts as a slide interface facility, forward end 140, rear end 142, and opposed major right and left faces 144, 146. A trigger element 148 protrudes downwardly from the lower surface of the sub receiver. The trigger element is received by a trigger opening 150 in the body communicating with the trigger space 118, thereby enabling the trigger element to extend into the trigger space when the sub receiver is in the connected position. The recoil lug 120, which is also forward of the trigger opening, is received within a slot 152 located in the lower surface of the sub receiver in front of the trigger. The slot has opposed parallel sidewalls. The slot includes a rear-facing second bearing surface 294 adapted to abut the forward-facing first bearing surface 292 of the recoil lug. A front frame pin 154 is inserted through bore 156 in the right face of the sub receiver and bore 122 in the recoil lug, which are registered when the sub receiver is in the connected position, to releasably secure the sub receiver to the body. The forward end of the sub receiver includes a forward protrusion 158 defining a bore 160 and a first mounting facility 162. In the current embodiment, the first mounting facility is a pair of recesses 164, 166. The recesses are a pair of spaced-apart connection elements, each proximate to a respective opposed major right and left face. The forward end of the sub receiver also defines a first bore 168 that is in communication with the recesses. The trigger mechanism housing 206 extends downwardly from the lower surface of the sub receiver adjacent to the rear end. The trigger mechanism housing defines a bore 208 and a downward facing slot 210.

When the sub receiver is attached to the body, the downward facing slot receives the rear protrusion 128 on the body, and a rear frame pin 212 is inserted through the bore 208 and the bore (not visible) and the rear protrusion on the body to releasably secure the rear end of the sub receiver to the body. The recoil lug being received by the slot and the rear protrusion being received by the downward facing slot both serve as mating elements on the body and on the sub receiver adjacent to the magazine passage 124 and adapted to prevent sliding motion of the sub receiver with respect to the upper surface of the body. It should be appreciated that the sub receiver can be viewed as a portion of the body from the perspective of the remaining components of the pistol 100 once the sub receiver is connected to the body.

A front dust cover 170, which is an elongated form, is releasably attached to the forward end 140 of the sub receiver 134. The front dust cover has a forward end 172, rear end 174, upper surface 176, and lower surface 178. The upper surface defines a concave channel 180. The lower surface includes a Picatinny rail portion 182 or any other suitable type of accessory mount. The rear end includes a connection facility/second mounting facility 184 and defines a bore 186. In the current embodiment, the connection facility/second mounting facility is a pair of posts 188, 190 adjacent to right and left faces 192, 194 of the front dust cover. The posts are sized to be slidably received within the pair of recesses 164, 166 that form the first mounting facility 162. The rear end also defines a slot 196 that receives the protrusion 158 on the sub receiver when the posts are slidably received by the recesses. A screw 198 is threadedly received by the bore 186 in the front dust cover and bore 160 in the protrusion to releasably secure the front dust cover to the forward end of the sub receiver. A front dust cover pin 200 is inserted through first bore 168 in the sub receiver and second bore 202 in the front dust cover to further releasably secure the front dust cover to the forward end of the sub receiver. The first and second bores are registered when the front dust cover is in the attached position, and the front dust cover pin is closely received in the first and second bores to secure the front dust cover in the attached position. The front dust cover has a height at the rear end extending from the upper surface to the opposed lower surface. In the current embodiment, the front dust cover is cantilevered from the sub receiver.

A slide 204 is slidably attached to the upper slide interface surface 136 of the sub receiver 134 by slide rails 288 that define a horizontal slide plane. The slide reciprocates fore and aft in response to recoil forces resulting from the discharge of the pistol 100. The angled shape of the recoil lug 120 directs the recoil forces transmitted from the second bearing surface 294 of the sub receiver to the first bearing surface 292 of the recoil lug downwards into the body 112 to prevent undesirable muzzle rise that would otherwise be created by the recoil forces. The second bearing surface is parallel to the first bearing surface. The slide has a selected slide length between a rear slide end 270 and a forward slide end 272. The front dust cover 170 has a forward end 172 defining a front dust cover length with respect to the rear end 174 of the front dust cover. The length of the front dust cover is selected to extend to underlay the forward end of the slide with the forward end of the front dust cover registered with the forward end of the slide such that the front dust cover can be interchanged with a different length front dust cover to be compatible with a different length slide. The connection facility/second mounting facility 184 enables movement of the front dust cover with respect to the slide only in a vertical direction, and limits motion and all other directions.

A back grip strap element 214 is releasably attached to the rear end 142 of the sub receiver 134. The top of the back grip strap element includes a second linear interface element/dovetail 216 that slidably receives a first linear interface element/dovetail slot 218 located at the rear end 142 of the sub receiver 134. In the specification, the term dovetail feature is not limited to the traditional woodworking tapered shape. The first linear interface element is aligned with an attachment axis 286 offset from the magazine axis 284, which is perpendicular to the rim plane defined by the lower rim 274 of the body 112. The first linear interface element is parallel to the side plane defined by the slide rails 288. The first linear interface element and the second linear interface element form a sliding interface. The sliding interface includes a protrusion/male feature having a constant cross-section (the dovetail) and a recess/female element having a constant cross-section (the dovetail slot) adapted to closely receive the male element. In the specification, the term cylindrical is not limited to circular cross-section, but to forms having the same cross-sectional profile along their length. Thus, the sliding interface includes closely mating cylindrical forms defining a sliding axis 290. The back grip strap element includes pin cutouts 220, 222 that expose the bore 208 in the trigger mechanism housing 206 to enable rear frame pin 212 to be inserted into the bore. The bottom of the back grip strap element defines a downwardly facing slot 224 having a threaded bore 226. It should be appreciated that the back grip strap element depends only from the rear end of the sub receiver and is not attached to the rear of the body 112, but merely abuts the rear of the body.

The magazine well funnel element 228 is removably connected to the bottom of the back grip strap 214. The top of the magazine well funnel element has an upwardly facing protrusion 230 with a passage 232 that is received within the downwardly facing slot 224 of the back grip strap 214. A fastener in the form of screw 234 is received by the passage 232 and threadedly engaged with the threaded bore 226 in the back grip strap element 214 to releasably attach the magazine well funnel element to the bottom of the back grip strap. The sub receiver 134, back grip strap element, and magazine well funnel element effectively form a C-clamp around the pistol grip frame 32, which enables the back grip strap and magazine well funnel element to be held tightly against the pistol grip frame to compress the pistol grip frame without a fastener connecting the back grip strap element to the body. The top of the magazine well funnel element also includes a front tab 236, rear tab 238, right tab 240, and left tab 242. The front tab includes a forward protrusion 244. The tabs are received within the magazine passage 124 of the body 112 at the lower rim 274 of the body with the forward protrusion within the dovetail 126 to align a magazine well opening/funnel inlet 246 in registration with the magazine passage. The tabs serve as a second engagement adapted to prevent the magazine well funnel element from sliding with respect to the lower rim of the grip. In the current embodiment, the funnel inlet is tapered to facilitate insertion of a magazine (not shown) through the funnel inlet and into the magazine passage. The magazine well funnel element also includes an engagement facility adapted to prevent separation of a forward portion of the magazine well funnel element (the front tab) away from the body. In the current embodiment, the engagement facility is a hook element 278 having an engagement surface 280 facing away from the grip. The hook element extends in a forward direction to enable removal of the magazine well funnel element from the body only in a rearward direction.

Figure 15:
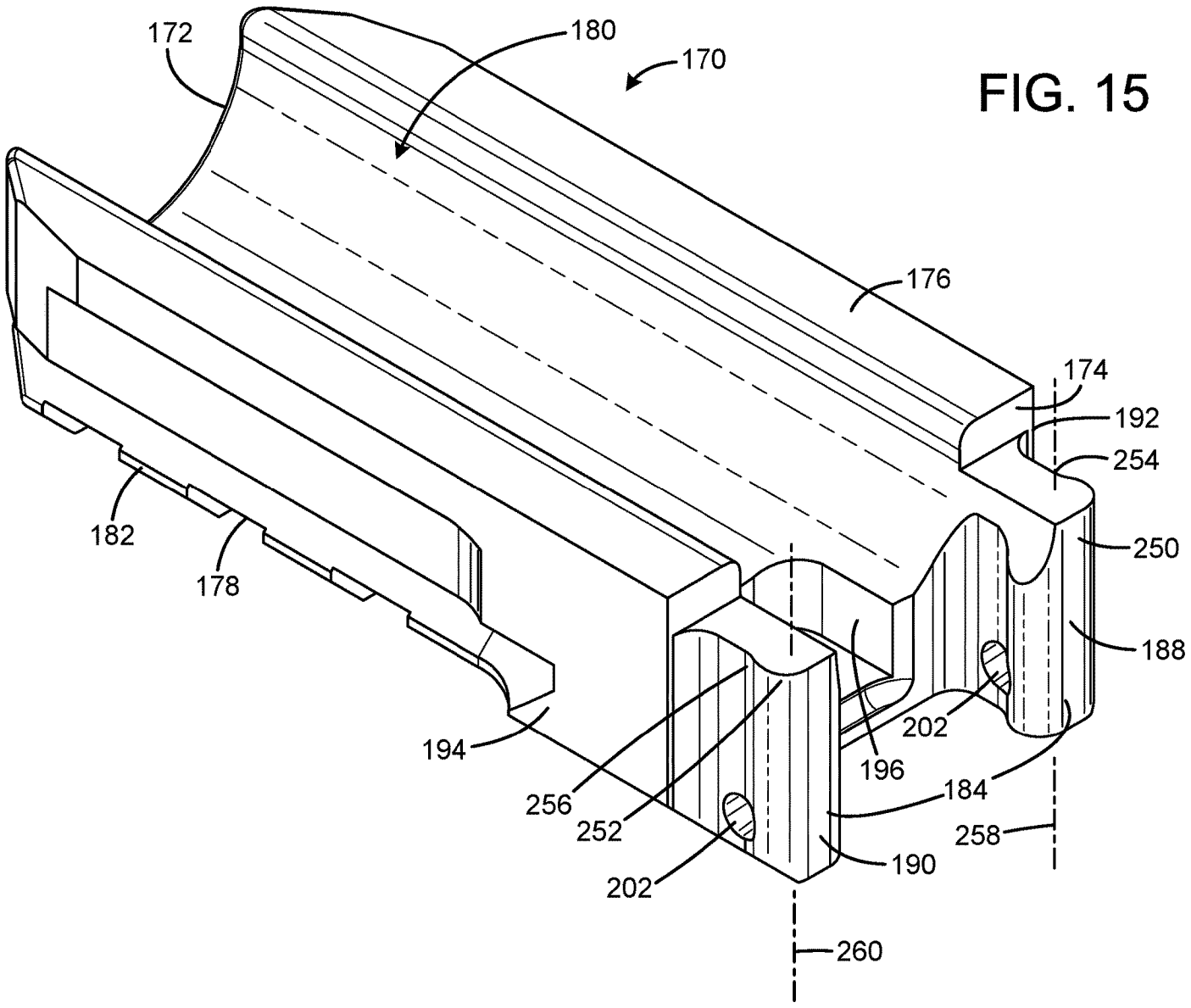
FIG. 15 is a rear isometric view of the dust cover of FIG. 10.
Figure 16:
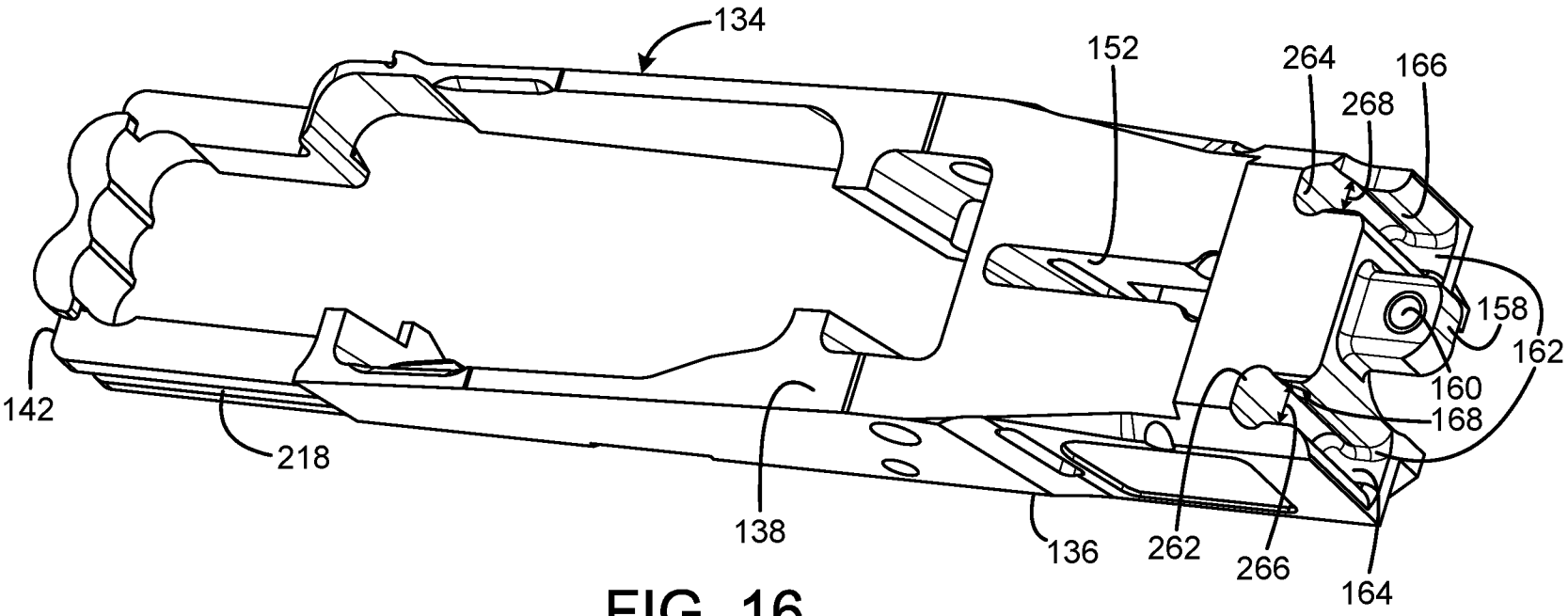
FIG. 16 is a bottom front isometric view of the sub receiver of FIG. 10.
Figure 17:
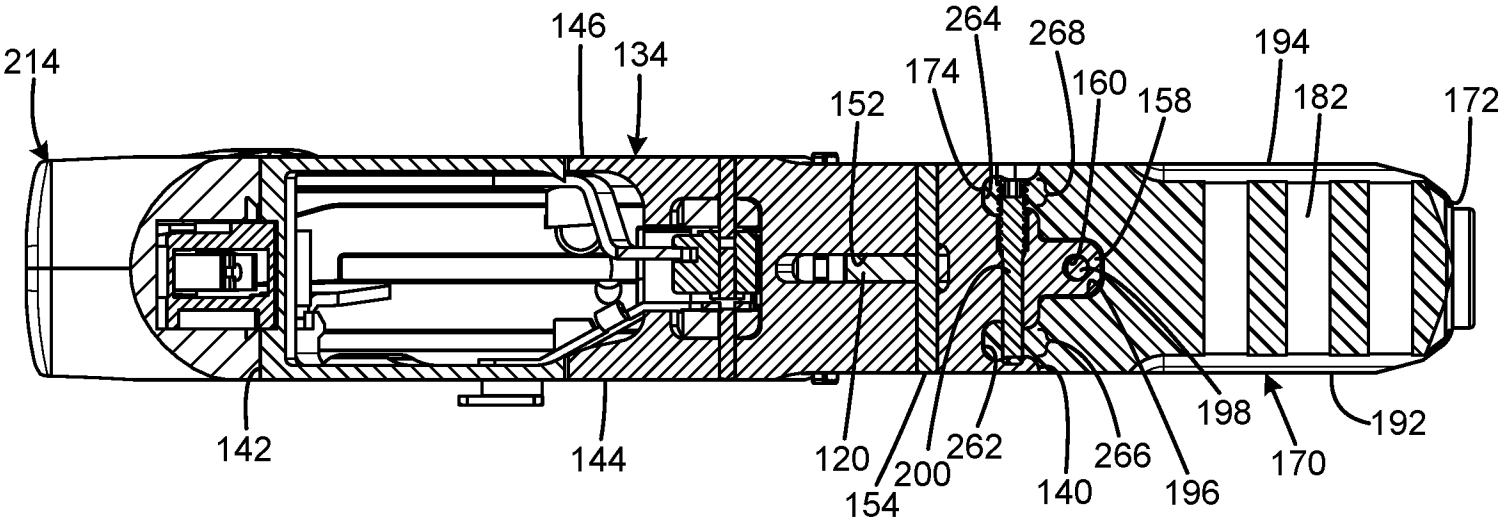
FIG. 17 is a bottom sectional view of the pistol of FIG. 10.

FIGS. 15-17 illustrate how the sub receiver 134 and the front dust cover 170 of the improved pistol 100 of the present invention form a puzzle lock to releasably secure the sub receiver to the front dust cover. More particularly, in FIG. 15, it can be appreciated that posts 188, 190 of the second mounting facility 184 are elongated protruding male elements defining a male constant cross-sectional cylindrical/profile having heads 250, 252 having a head width and necks 254, 256 having a second width less than the head width. The posts define sliding axes 258, 260 that are angularly offset/perpendicular to the slide interface plane defined by the upper slide interface surface 136. In FIG. 16, it can be appreciated that the recesses 164, 166 of the first mounting facility 162 are female elements having constant cross-sections defining passages 262, 264 adapted to closely receive the heads and gaps 266, 268 adapted to closely receive the necks. Thus, the second mounting facility is adapted to removably dock with the first mounting facility in an attached position. The upper surface 176 of the front dust cover is in the slide interface plane when the front dust cover is in the attached position, and the first mounting facility and second mounting facility form a sliding interface. In the current embodiment, the sliding interface is a dovetail feature, which is defined as any feature having a wider head than an associated neck. In the specification, the term dovetail feature is not limited to the traditional woodworking tapered shape. Furthermore, in the specification, the term cylindrical is not limited to circular cross-sections, but to forms having the same cross-sectional profile along their length. Thus, sliding interface is perpendicular to the slide interface plane and includes closely mating cylindrical forms that also define the sliding axes. The sliding interface includes elongated connection elements (the posts) that extend from a lower end proximate the lower surface 178 of the front dust cover to an upper end proximate the upper surface of the front dust cover. In the current embodiment, the posts extend from the lower surface of the front dust cover to a location 0.0965 inches below the upper surface of the dust cover. The puzzle lock between the front dust cover and the sub receiver and the transverse front dust cover pin provide strength and resistance to bending. These characteristics are essential because the front dust cover is cantilevered and can receive lights or other accessories on the Picatinny rail portion 182 that add weight to the forward end of the front dust cover.

Figure 18:
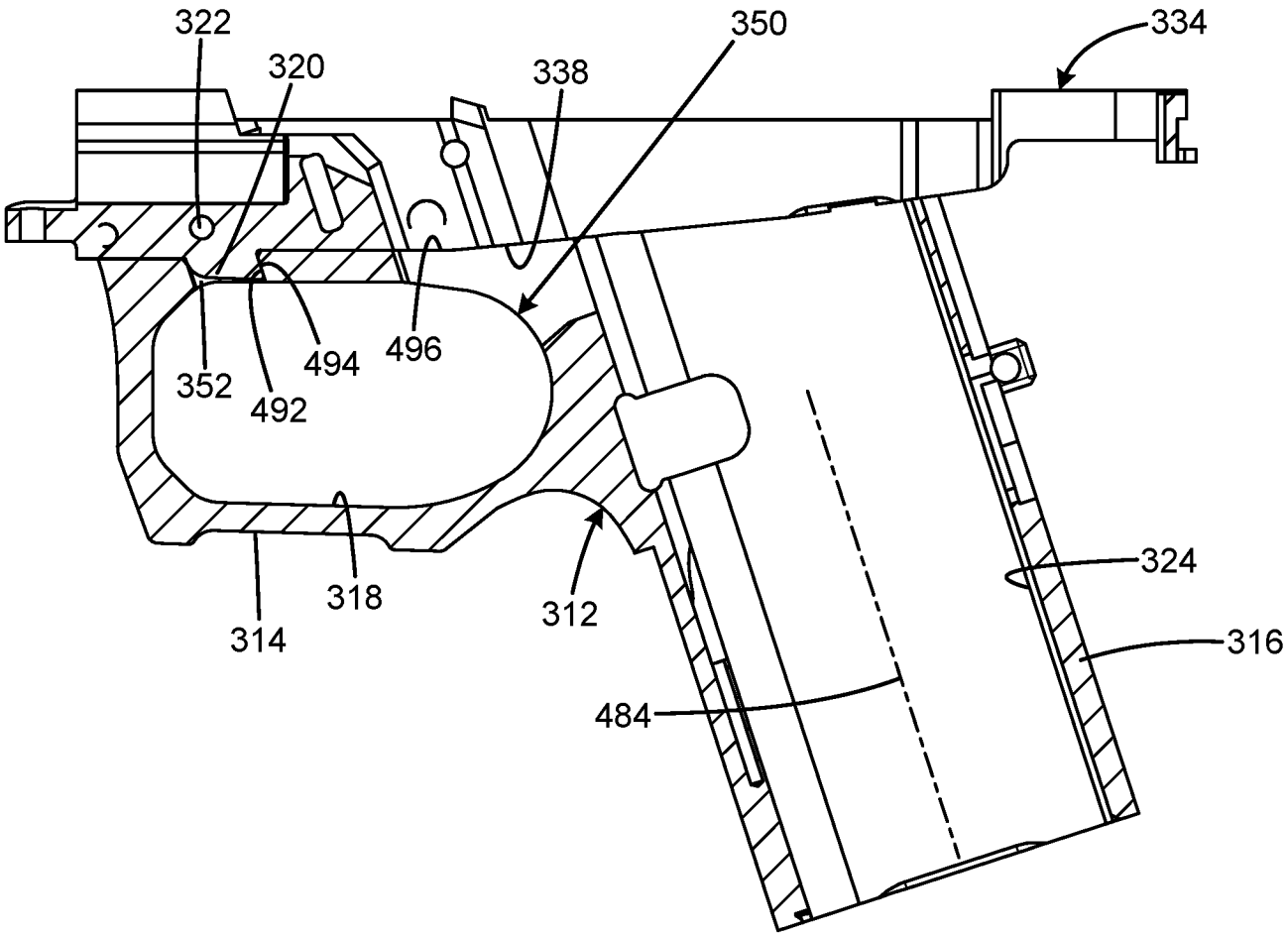
FIG. 18 is a left side sectional view of a second alternative embodiment of the pistol constructed in accordance with the principles of the present invention.

FIG. 18 illustrates an alternative embodiment of the improved pistol 300 of the present invention. More particularly, the pistol has a body 312 having a forward trigger guard 314, a rearward grip 316, and an upper surface 496. The trigger guard defines a trigger space 318. A trigger opening 350 in the body communicates with the trigger space 118. A slot 352 having opposed parallel sidewalls is located on top of the trigger guard forward of an elongated central magazine passage 324 defined by the grip. The slot is defined by the upper surface of the body and has a forward-facing first bearing surface 492. The magazine passage is adapted to receive a magazine and defines a magazine axis 484. The grip has opposed left and right side walls, a front portion, and an opposed rear portion.

A sub receiver 334 is removably connected to the upper surface 496 of the body 312 in a connected position where the lower surface 338 of the sub receiver abuts the upper surface of the body, thereby enabling the trigger element to extend into the trigger space when the sub receiver is in the connected position. A recoil lug 320 having a transverse bore 322 is a protrusion extending downward from the lower surface of the sub receiver having a rearward-facing second bearing surface 294. The recoil lug, which is forward of the trigger opening 350, is received within slot 352. The recoil lug includes a rear-facing second bearing surface 494 adapted to abut the forward-facing first bearing surface 492 of the slot. It should be appreciated that the sub receiver can be viewed as a portion of the body from the perspective of the remaining components of the pistol 300 once the sub receiver is connected to the body.

Figure 19:
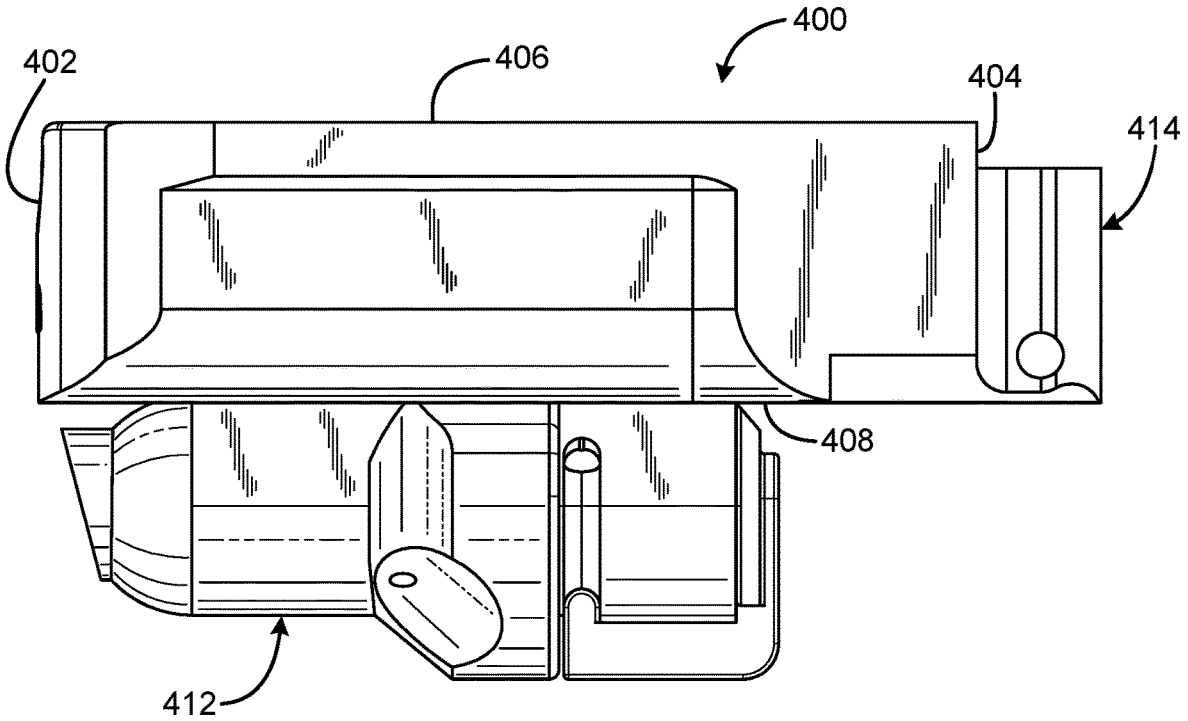
FIG. 19 is left side view of a first alternative embodiment of the front dust cover incorporating a laser emitter suitable for use with the pistols of FIGS. 10 and 18.

FIG. 19 illustrates a first alternative embodiment of the improved front dust cover 400 of the present invention. More particularly, the front dust cover 400 is suitable for use with pistols 200 or 300. The front dust cover 400, which is an elongated form, is releasably attached to the forward end of the sub receiver of pistols 200 or 300. The front dust cover has a forward end 402, rear end 404, upper surface 406, and lower surface 408. The upper surface defines a concave channel (not visible). The lower surface includes a laser emitter 412. The rear end includes the same connection facility/second mounting facility 414 as does the front dust cover 170 (a pair of posts and a slot). Thus, the sub receiver of pistols 200 or 300 and the front dust cover 400 of the present invention form a puzzle lock to releasably secure the sub receiver to the front dust cover 400. The front dust cover 400 also has the same bores as the front dust cover 170 to receive the same screw and front dust cover pin to secure the front dust cover 400 to the forward end of the sub receiver of pistols 200 or 300 in the same manner.

Figure 20:
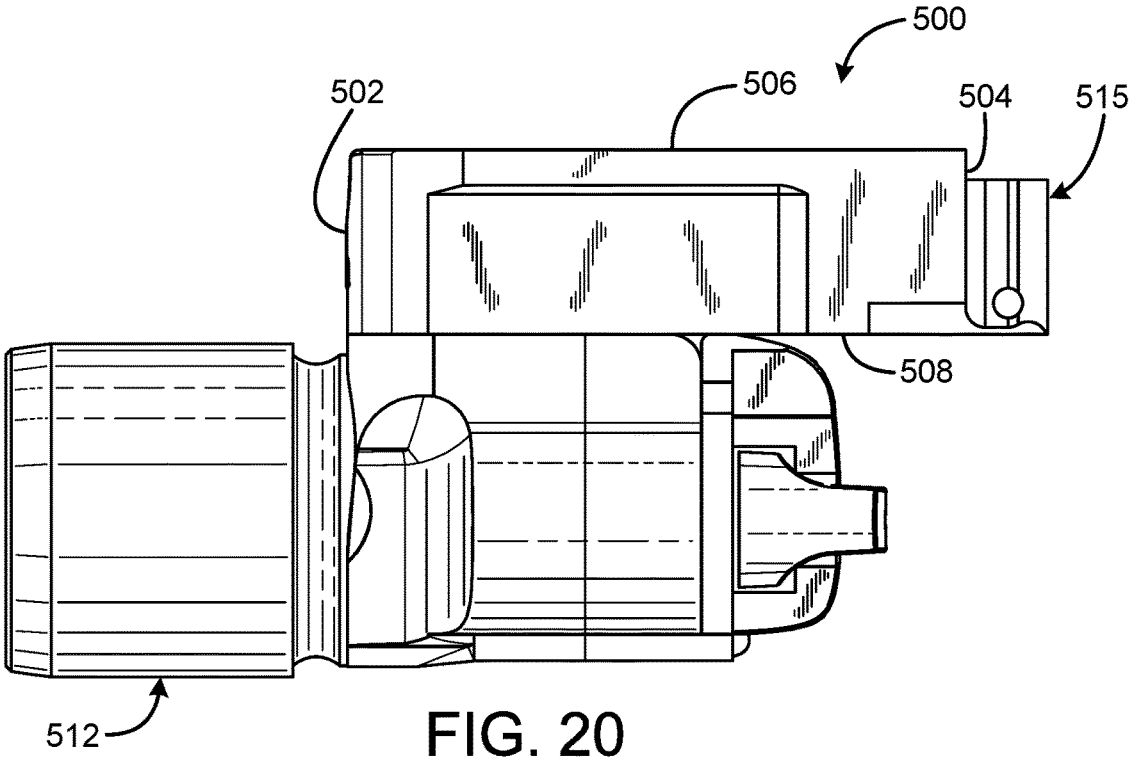
FIG. 20 is left side view of a second alternative embodiment of the front dust cover incorporating a light suitable for use with the pistols of FIGS. 10 and 18.

FIG. 20 illustrates a second alternative embodiment of the improved front dust cover 500 of the present invention. More particularly, the front dust cover 500 is suitable for use with pistols 200 or 300. The front dust cover 500, which is an elongated form, is releasably attached to the forward end of the sub receiver of pistols 200 or 300. The front dust cover has a forward end 502, rear end 504, upper surface 506, and lower surface 508. The upper surface defines a concave channel (not visible). The lower surface includes a light 512. The rear end includes the same connection facility/second mounting facility 514 as does the front dust cover 170 (a pair of posts and a slot). Thus, the sub receiver of pistols 200 or 300 and the front dust cover 500 of the present invention form a puzzle lock to releasably secure the sub receiver to the front dust cover 500. The front dust cover 500 also has the same bores as the front dust cover 170 to receive the same screw and front dust cover pin to secure the front dust cover 500 to the forward end of the sub receiver of pistols 200 or 300 in the same manner.

Figure 21:
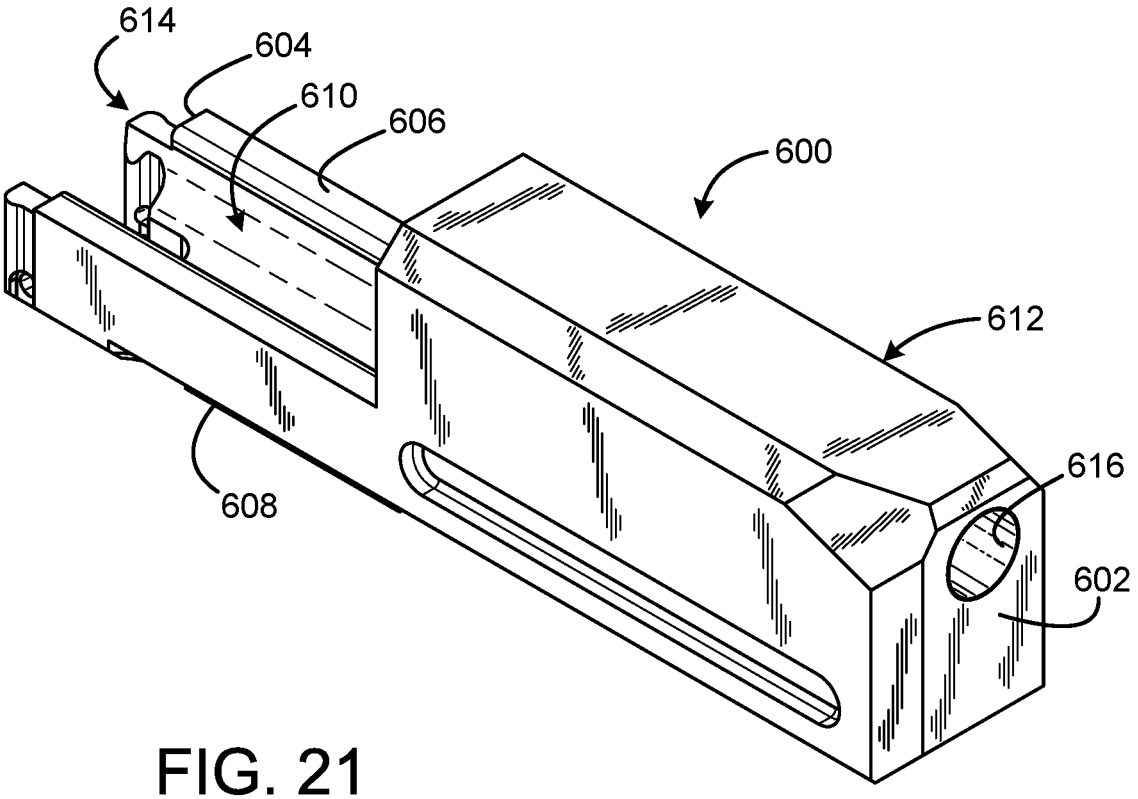
FIG. 21 is front isometric view of a third alternative embodiment of the front dust cover incorporating a suppressor suitable for use with the pistols of FIGS. 10 and 18.

FIG. 21 illustrates a third alternative embodiment of the improved front dust cover 600 of the present invention. More particularly, the front dust cover 600 is suitable for use with pistols 200 or 300. The front dust cover 600, which is an elongated form, is releasably attached to the forward end of the sub receiver of pistols 200 or 300. The front dust cover has a forward end 602, rear end 604, upper surface 606, and lower surface 608. A rear portion of the upper surface defines a concave channel 610. A forward portion of the upper surface includes a suppressor 612 that sits in front of the muzzle of pistols 200 or 300. The rear end includes the same connection facility/second mounting facility 614 as does the front dust cover 170 (a pair of posts and a slot). Thus, the sub receiver of pistols 300 or 400 and the front dust cover 600 of the present invention form a puzzle lock to releasably secure the sub receiver to the front dust cover 600. The front dust cover 600 also has the same bores as the front dust cover 170 to receive the same screw and front dust cover pin to secure the front dust cover 600 to the forward end of the sub receiver of pistols 200 or 300 in the same manner. Furthermore, the alignment of the connection of the front dust cover 600 to the sub receiver of pistols 200 or 300 is repeatable. This enables the front dust cover 600 to be repeatedly removed and reinstalled without creating a risk of bullet strikes on the baffles (not visible) within the suppressor as the bullet enters through a rear passage (not visible) and exits through front passage 616.

Figure 22:
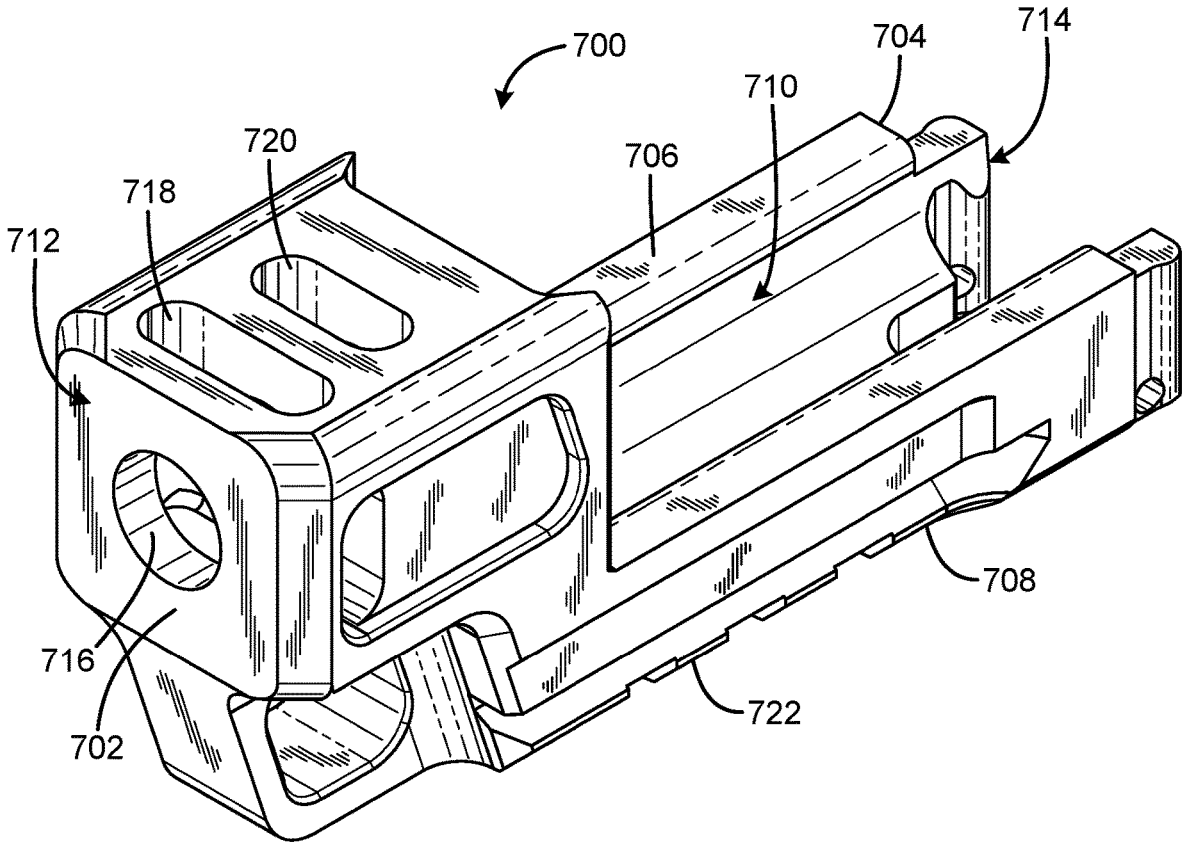
FIG. 22 is front isometric view of a fourth alternative embodiment of the front dust cover incorporating a compensator suitable for use with the pistols of FIGS. 10 and 18.

FIG. 22 illustrates a fourth alternative embodiment of the improved front dust cover 700 of the present invention. More particularly, the front dust cover 700 is suitable for use with pistols 200 or 300. The front dust cover 700, which is an elongated form, is releasably attached to the forward end of the sub receiver of pistols 200 or 300. The front dust cover has a forward end 702, rear end 704, upper surface 706, and lower surface 708. A rear portion of the upper surface defines a concave channel 710. A forward portion of the upper surface includes a compensator 712 that sits in front of the muzzle of pistols 200 or 300. The rear end includes the same connection facility/second mounting facility 714 as does the front dust cover 170 (a pair of posts and a slot). Thus, the sub receiver of pistols 200 or 300 and the front dust cover 700 of the present invention form a puzzle lock to releasably secure the sub receiver to the front dust cover 700. The front dust cover 700 also has the same bores as the front dust cover 170 to receive the same screw and front dust cover pin to secure the front dust cover 700 to the forward end of the sub receiver of pistols 200 or 300 in the same manner. Furthermore, the alignment of the connection of the front dust cover 700 to the sub receiver of pistols 200 or 300 is repeatable. This enables the front dust cover 700 to be repeatedly removed and reinstalled without creating a risk of bullet strikes on the compensator as the bullet passes through front passage 716. The top of the compensator defines a front vent 718 and a rear vent 720 that vent a portion of the hot gasses emitted by the muzzle of pistols 200 or 300 upwards to compensate for muzzle rise resulting from recoil forces. A portion of the lower surface of the front dust cover 700 includes a Picatinny rail portion 722 or any other suitable type of accessory mount.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While current embodiments of a pistol have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pistol frame comprising:

a body having a grip;

the grip defining an elongated magazine passage adapted to receive a magazine and defining a magazine axis;

the grip having opposed left and right side walls and a front portion and an opposed rear portion;

the body having an upper portion having a first linear interface element aligned with an attachment axis angularly offset from the magazine axis; and a removable backstrap element adapted to overlay the rear portion of the grip and having a second linear interface element adapted to removably connect to the first linear interface element.

2. The pistol frame of claim 1 wherein the pistol frame includes slide rails defining a slide plane, and the first linear interface element is parallel to the slide plane.

3. The pistol frame of claim 1 wherein the first linear interface element and the second linear interface element comprise a sliding interface.

4. The pistol frame of claim 3 wherein the sliding interface is a dovetail feature.

5. The pistol frame of claim 3 wherein the sliding interface includes a male element having a constant cross section as one of the first and second front strap attachment facilities, and a female element having a constant cross section adapted to closely receive the male element.

6. The pistol frame of claim 3 wherein the sliding interface includes closely mating cylindrical forms on the first and second linear interface elements when they are connected and defines a sliding axis.

7. The pistol frame of claim 1 including a protrusion on one of the first and second linear interface elements, and a recess adapted to closely receive the protrusion on the other of the linear interface elements.

8. A pistol frame comprising:

a body having a grip;

the grip defining an elongated magazine passage adapted to receive a magazine and defining a magazine axis;

the grip having opposed left and right side walls and a front portion and an opposed rear portion;

the body having an upper portion having a first linear interface element aligned with an attachment axis offset from the magazine axis;

a second linear interface element adapted to removably connect to the first linear interface element; and wherein the grip has a lower rim, and the pistol frame further comprising a funnel element adapted for connection to the frame at the lower rim at an installed location.

9. The pistol frame of claim 8 wherein the funnel element defines a magazine opening registered with the magazine passage.

10. The pistol frame of claim 8 wherein the lower rim of the grip defines a rim plane, and a front path is perpendicular to the rim plane.

11. The pistol frame of claim 8 wherein the funnel element is removably connected to the back strap element.

12. The pistol frame of claim 11 including a fastener engaging the funnel element and the backstrap element.

13. The pistol frame of claim 12 wherein the backstrap element defined a threaded bore, the funnel element defines a passage, and the fastener occupies the threaded bore and passage.

14. The pistol frame of claim 8 wherein funnel element has an engagement facility adapted to prevent separation of a forward portion of the funnel element away from the grip.

15. The pistol frame of claim 8 wherein the funnel element includes a second engagement adapted to prevent the funnel element from sliding with respect to the grip lower rim.

16. The pistol frame of claim 14 wherein the engagement facility includes a hook element having an engagement surface facing away from the grip.

17. The pistol frame of claim 16 wherein the hook element extends in a forward direction to enable removal of the funnel element from the grip only in a rearward direction.

18. The pistol frame of claim 1 wherein the upper portion of body is removable from grip.

19. The pistol frame of claim 1 wherein the backstrap element overlays the grip, but is rearwardly removable therefrom.

20. The pistol frame of claim 1 wherein the backstrap element is not secured directly to the grip against rearward separation.

* * * * *